US011587715B2

(12) United States Patent
Stith

(10) Patent No.: US 11,587,715 B2
(45) Date of Patent: Feb. 21, 2023

(54) TRANSFORMER TIE DOWN

(71) Applicant: GMS Manufacturing, LLC, Lexington, KY (US)

(72) Inventor: Gregg Stith, Dry Ridge, KY (US)

(73) Assignee: GMS MANUFACTURING, LLC, Lexington, KY (US)

( * ) Notice: Subject to any disclaimer, the term of this patent is extended or adjusted under 35 U.S.C. 154(b) by 302 days.

(21) Appl. No.: 16/987,988

(22) Filed: Aug. 7, 2020

(65) Prior Publication Data

US 2021/0043356 A1 Feb. 11, 2021

Related U.S. Application Data

(60) Provisional application No. 62/884,848, filed on Aug. 9, 2019.

(51) Int. Cl.
*H01F 27/06* (2006.01)

(52) U.S. Cl.
CPC ..... *H01F 27/06* (2013.01)

(58) Field of Classification Search
CPC ... H01F 27/00–40; H01F 27/06; H01F 27/002
See application file for complete search history.

(56) References Cited

U.S. PATENT DOCUMENTS 3,249,903 A * 5/1966 Clark ..... H01F 27/02 336/67
3,441,885 A * 4/1969 Marks ..... H01F 38/30 336/84 R
3,962,660 A * 6/1976 Duckett ..... H02B 7/06 248/346.02
2009/0066270 A1* 3/2009 Dause ..... H05K 7/1432 318/34
2011/0248808 A1* 10/2011 Singh ..... H01F 27/327 336/5

* cited by examiner

*Primary Examiner* — Tuyen T Nguyen
(74) *Attorney, Agent, or Firm* — Dinsmore & Shohl LLP

(57) ABSTRACT

An apparatus for securing a transformer that includes a mounting bracket coupled to an exterior surface of the transformer, the mounting bracket having a first length, a first height, and a first width to define a mounting bracket having an interior cavity includes a housing having a second length, a second height, and a second width to define an interior cavity with at least one interior surface. The second length is larger than the first length of the mounting bracket and the second width is larger than the first width such that the mounting bracket is receivable into the interior cavity. A shaft member extends from the at least one interior surface along the second length within the housing interior cavity. The shaft member receives a securing strap around at least a portion of the shaft member within the mounting bracket to secure the transformer to the apparatus.

20 Claims, 6 Drawing Sheets

TRANSFORMER TIE DOWN

CROSS-REFERENCE TO RELATED APPLICATION

This application claims the benefit of U.S. Provisional Application No. 62/884,848, filed Aug. 9, 2019, the entirety of which is hereby incorporated by reference.

TECHNICAL FIELD

The present specification generally relates to an apparatus for securing a transformer for transportation.

BACKGROUND

Power transformers are used in electrical power transmission, distribution, and generation. Power transformers are generally classified by the operating power level for which they are designed. For example, power transformers may be classified as high-power, medium-power, and low-power transformers. The size of a power transformer correlates to their designed power level. Power transformers used for high-power and medium-power applications such as power transmission and power generation may be have a size similar to that of a small vehicle or as large as a train car. Power transformers used for distribution, for example pole transformers that are commonly seen on utility poles along streets and in neighborhoods are considerably smaller in size than medium-power and high-power transformers. Overhead transformers commonly need to be replaced by utility companies to maintain, upgrade, or expand power distribution networks. Due to their size, overhead transformers are commonly transported to and from an installation site via a utility truck. Due to the generally cylindrical shape of overhead transformers, securing them to a utility truck for transport can be complex and even time consuming. More importantly, failing to securely fix an overhead transformer to a utility truck may result in the overhead transformer falling over in the truck or even falling off the truck. This may cause damage to the overhead transformer. The overhead transformer case to crack causing cooling oil to spill out. Damage to the overhead transformer may not only require a replacement of the new overhead transformer but may result in costly cleanup and negative effects on the environment.

Therefore, there is a need for a device and method of securely fixing an overhead transformer to a utility truck for transportation to and from an installation site.

SUMMARY

In an embodiment, an apparatus for securing a transformer that includes at least one mounting bracket coupled to an exterior surface of the transformer, the at least one mounting bracket having a first length, a first height, and a first width to define a mounting bracket having an interior cavity, the apparatus includes a housing having a second length, a second height, and a second width to define a housing interior cavity with at least one interior surface. The second length is larger than the first length of the mounting bracket and the second width is larger than the first width such that the mounting bracket is receivable into the housing interior cavity. The apparatus further includes a shaft member including a third length, a third height, and a third width to define an exterior surface, the shaft member extending from the at least one interior surface along the second length within the housing interior cavity. The third width is smaller than the first width and the second width to receive a securing strap around at least a portion of the exterior surface of the shaft member within the interior cavity of the mounting bracket to secure the transformer to the apparatus via the at least one mounting bracket.

In some embodiments, an apparatus for securing a transformer that includes at least one mounting bracket coupled to an exterior surface of the transformer, the at least one mounting bracket having a first length, a first height, and a first width to define a mounting bracket having an interior cavity, the apparatus includes a housing configured in an elongated U-shaped structure having an interior cavity defined by a second length, a second height, and a second width and at least partially enclosed on one end of the elongated U-shaped structure. The second length is larger than the first length of the mounting bracket and the second width is larger than the first width such that the mounting bracket is receivable into the interior cavity. The apparatus further includes a shaft member extending from the enclosed end of the elongated U-shaped structure within the elongated U-shaped structure along a portion of a length of the housing.

In some embodiments, a method for securing a transformer that includes a mounting bracket coupled to an exterior surface of the transformer, the mounting bracket having a first length, a first height, and a first width to define the mounting bracket having an interior cavity, the method includes positioning a housing such that mounting bracket is received within the housing, wherein the housing includes an elongated U-shaped structure having an interior cavity defined by a second length, a second height, and a second width and at least partially enclosed on one end of the elongated U-shaped structure, wherein the second length is larger than the first length of the mounting bracket and the second width is larger than the first width such that the mounting bracket is receivable into the interior cavity, and a shaft member extending from the enclosed end of the elongated U-shaped structure within the elongated U-shaped structure along a portion of a length of the housing. The method further includes feeding a securing strap around at least a portion of the shaft member such that opposing ends of the securing strap extend out of an opening of the elongated U-shaped structure, and applying tension to the opposing ends of the securing strap such that the housing is pulled into a mating position with the mounting bracket of the transformer.

BRIEF DESCRIPTION OF THE DRAWINGS

The embodiments set forth in the drawings are illustrative and exemplary in nature and are not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein relate to devices and methods of securing an overhead transformer to a vehicle for transportation. The device, which is referred to herein as a "transformer tie down," provides a mechanism for attaching a securing strap to a mounting bracket of an overhead transformer. The securing strap may be connected to anchor points on the vehicle while a portion of the strap forms an open-loop that is fed into and through the mounting bracket of the overhead transformer. The transformer tie down includes a shaft member that extends from an enclosed end of a U-shaped housing toward an open end of the U-shaped housing. The shaft member may be positioned such that the open-loop of the securing strap is positioned between the shaft member and a bottom surface of the U-shaped housing. As the securing strap is tightened the transformer tie down engages the mounting bracket of the overhead transformer and secures the overhead transformer to the vehicle. In some embodiments, the device described herein may also be used to secure a transformer to a pallet or other transportation structure or container. That is, the use of the devices described herein are not limited to use as a mechanism for securing a transformer to a vehicle, but rather also as a mechanism for securing the transformer to a pallet, rail car, trailer, ship, cargo area of a plane or the like.

The following will now describe the transformer tie down in more detail with reference to the drawings and where like numbers refer to like structures.

Figure 1:
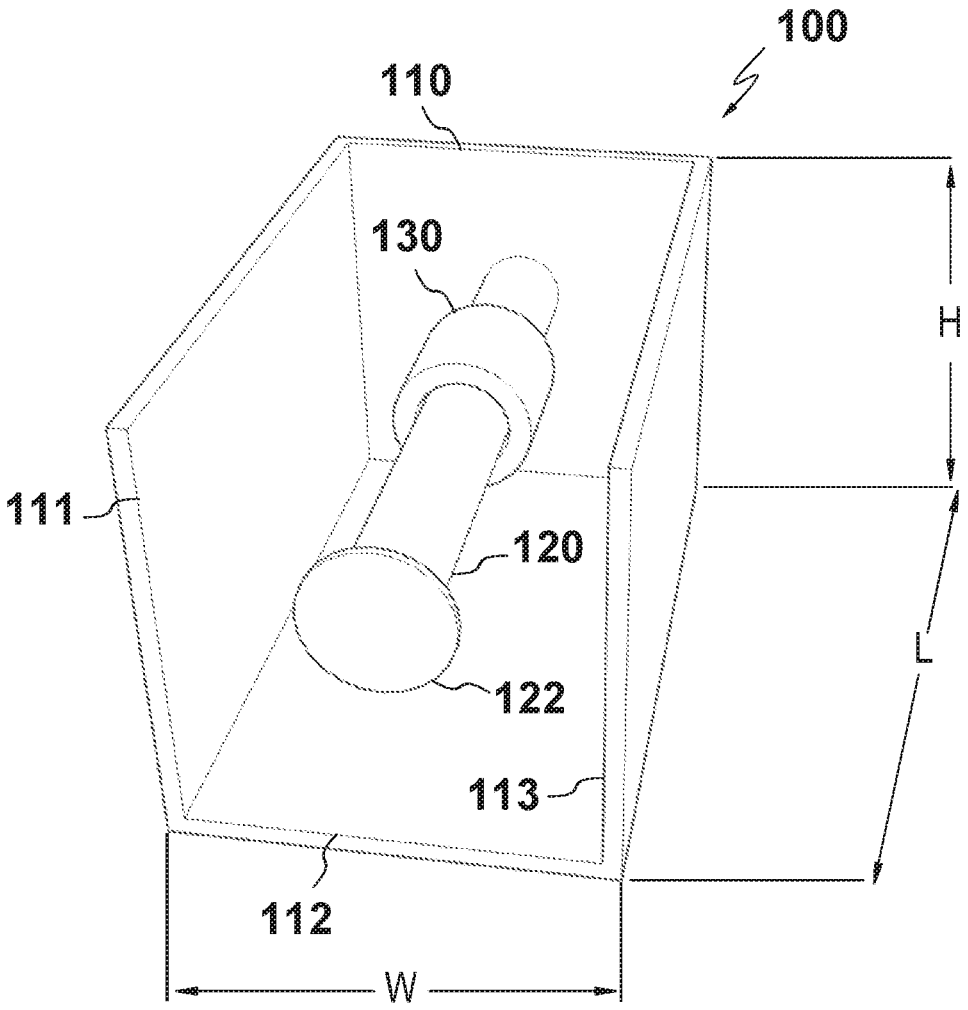
FIG. 1 depicts a perspective view of an illustrative schematic of a transformer tie down, according to one or more embodiments shown and described herein.

Referring to FIG. 1, a perspective view of an illustrative schematic of a transformer tie down 100 is depicted. The transformer tie down 100 depicted in FIG. 1 is merely one example of a transformer tie down contemplated within the scope of the present disclosure. The transformer tie down 100 includes a housing configured to receive a mounting bracket of an overhead transformer and a shaft member 120 configured within the housing to engage with a securing strap and the mounting bracket of the overhead transformer, which is depicted and described in more detail herein.

Figure 3:
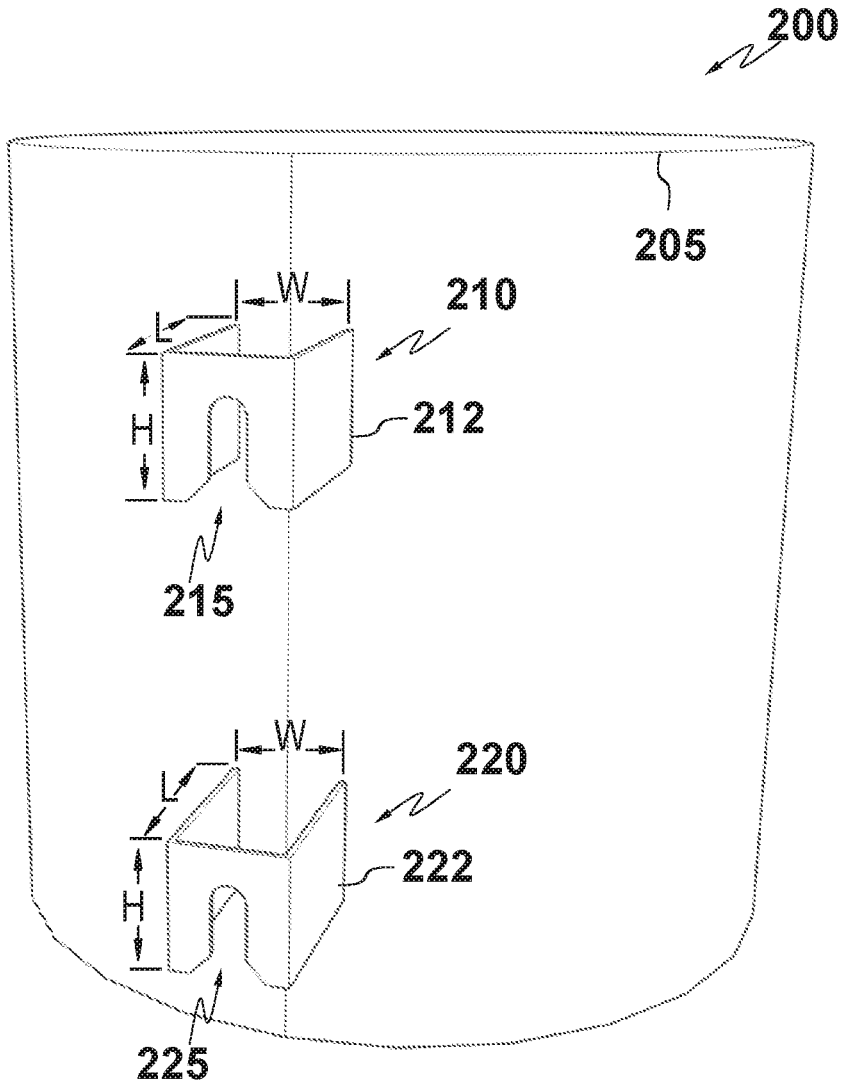
FIG. 3 depicts an illustrative example of an overhead transformer, according to one or more embodiments shown and described herein.
Figure 5:
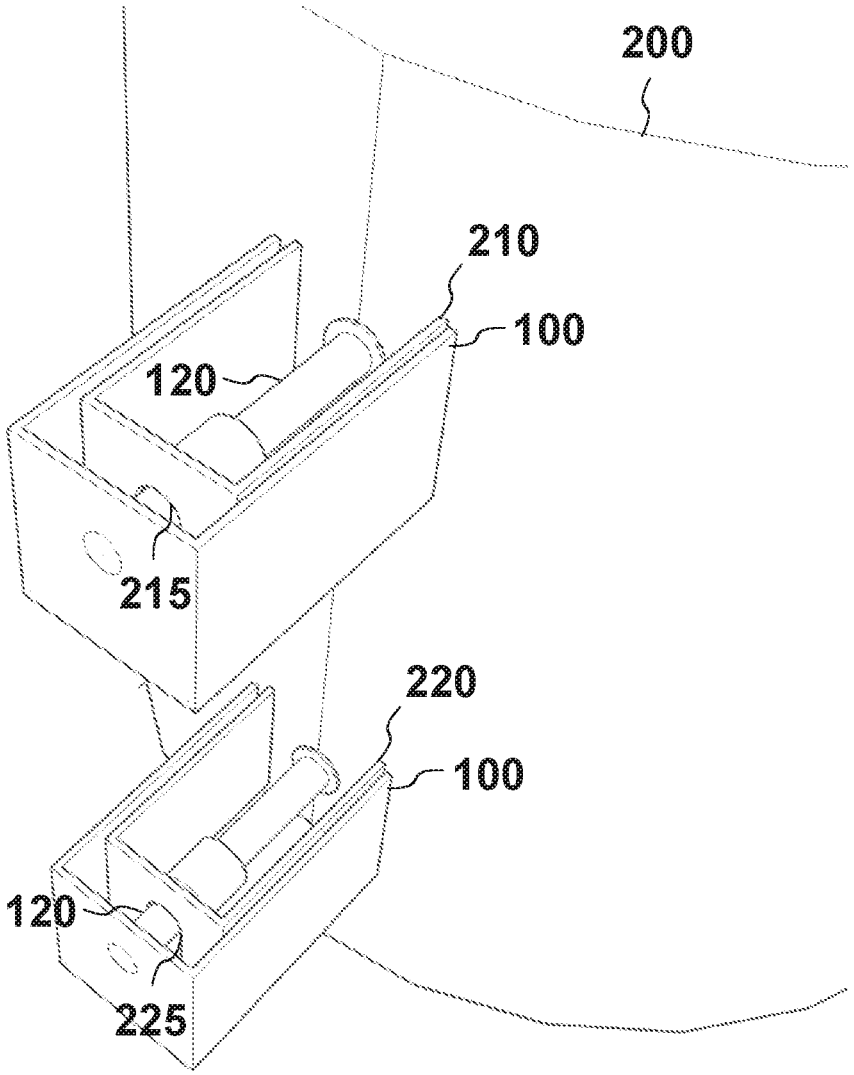
FIG. 5 depicts a perspective view of two transformer tie downs installed with the mounting brackets of the overhead transformer, according to one or more embodiments shown and described herein.

Referring briefly to FIG. 3, the transformer 200 includes one or more mounting brackets 210, 220, which may be used to mount and/or transport the transformer 200. The mounting bracket 210, 220 is coupled to an exterior surface of the transformer 200. The mounting bracket 210, 220 has a first length (L), a first height (H), and a first width (W) to define a mounting bracket interior cavity. Referring back to FIG. 1, the transformer tie down 100, also referred to herein as the apparatus, includes a second length (L), a second height (H), and a second width (W) to define a housing interior cavity with at least one interior surface. The second length (L) is larger than the first length of the mounting bracket 210, 220 and the second width is larger than the first width of the mounting bracket 210, 220 such that the mounting bracket 210, 220 is receivable into the housing interior cavity, for example, as depicted in FIG. 5.

Additionally, a shaft member 120 including a third length, a third height, and a third width extends from the at least one interior surface along the second length within the housing interior cavity. The third width is smaller than the first width and the second width to receive a securing strap around at least a portion of the exterior surface within the mounting bracket interior cavity to secure the transformer to the apparatus via the at least one mounting bracket.

The housing may be a rounded elongated U-shaped structure or a rectangular elongated U-shaped structure (generally referred to herein as an elongated U-shaped structure). For example, the housing of the transformer tie down, may be defined by one or more walls. The housing of the transformer tie down may include three walls forming an elongated U-shaped structure. For example, the elongated U-shaped structure of the housing includes a first wall 111 and a second wall 113 opposite the first wall 111. The first wall 111 and the second wall 113 are spaced apart by and coupled together by a bottom wall 112. The elongated U-shaped structure formed by the first wall 111, the bottom wall 112, and the second wall 113 is enclosed on one end by a back wall 110. The back wall 110 may be secured to an edge of the first wall 111, the second wall 113, and the bottom wall 112. Each of the walls may be secured by a weld, other type of fastener, or otherwise formed as a single component.

In some embodiments, the first wall 111 and the second wall 113 are defined by the dimensions of, for example but not limited to, a height (H) of about 3 inches or 3¼ inches and a length (L) of about 5 inches. The back wall 110 may have a height (H) of about 3 inches or about 3⅜ inches and a width (W) of about 3 inches or about 3¼ inches. Furthermore, the bottom wall 112 may have a width (W) of about 3 inches or about 3¼ inches and a length (L) of about 5 inches. The thickness of each wall may be about ¼ inch, about ⅛ inch, about 1/16 inch, about 1/32 inch or any thickness between about ¼ inch and about 1/32 inch. However, these are only example dimensions and some embodiments may have different dimensions such that the transformer tie down 100 mates with different sized and shaped mounting brackets of an overhead transformer. Furthermore, one or more of the back wall 110, the first wall 111, the bottom wall 112, and/or the second wall 113 may not be solid members full enclosing the space in which they structurally define. For example, the bottom wall 112 may be a structural member extending between the first wall 111 and the second wall 113 along a portion of the length (L) of the first wall 111 and the second wall 113, optionally not entire length (L).

The back wall 110 includes an extended portion (referred to herein as a "shaft member 120") that substantially extends the length of the U-shaped housing. For example, without limitation, the shaft member 120 may be positioned about 1¾ inch from the base (e.g., where the back wall 110 and the bottom wall 112 meet) of the back wall 110. In some embodiments, the shaft member 120 may be symmetrically aligned between the sides of the back wall 110 (e.g., between the sides of the back wall 110 that couple to the first wall 111 and the second wall 113). It should be understood that these are only example dimensions provided for explanation and that the transformer tie down 100 may have dimensions similar to these or others that enable the transformer tie down 100 to mate with the mounting bracket of the overhead transformer. The shaft member 120 may be formed with, welded to, or otherwise attached to the back wall 110 of the transformer tie down 100. The shaft member 120 may be a solid or hollow rod. The shaft member 120 may have any cross-sectional closed shape such as a circle, square, triangle or the like. In some embodiments, the shaft member 120 may have a diameter of about ¼ inch, about ⅝ inch, about ¾ inch or the like. For example, the diameter of the shaft member 120 may be appropriately sized to fit within a slot of a mounting bracket of an overhead transformer, which is depicted and described with reference to FIGS. 4 and 5.

In some embodiments, an end of the shaft member 120 that is opposite the end that is attached to the back wall 110 may include a flange 122. The flange 122 includes a diameter that is greater than the diameter of the shaft member 120. In embodiments that include a flange 122, the flange 122 may operate to keep the securing strap in a desired position along the shaft member 120. In some embodiments, the flange 122 may be a washer welded on to the end of the shaft member 120.

Figure 2:
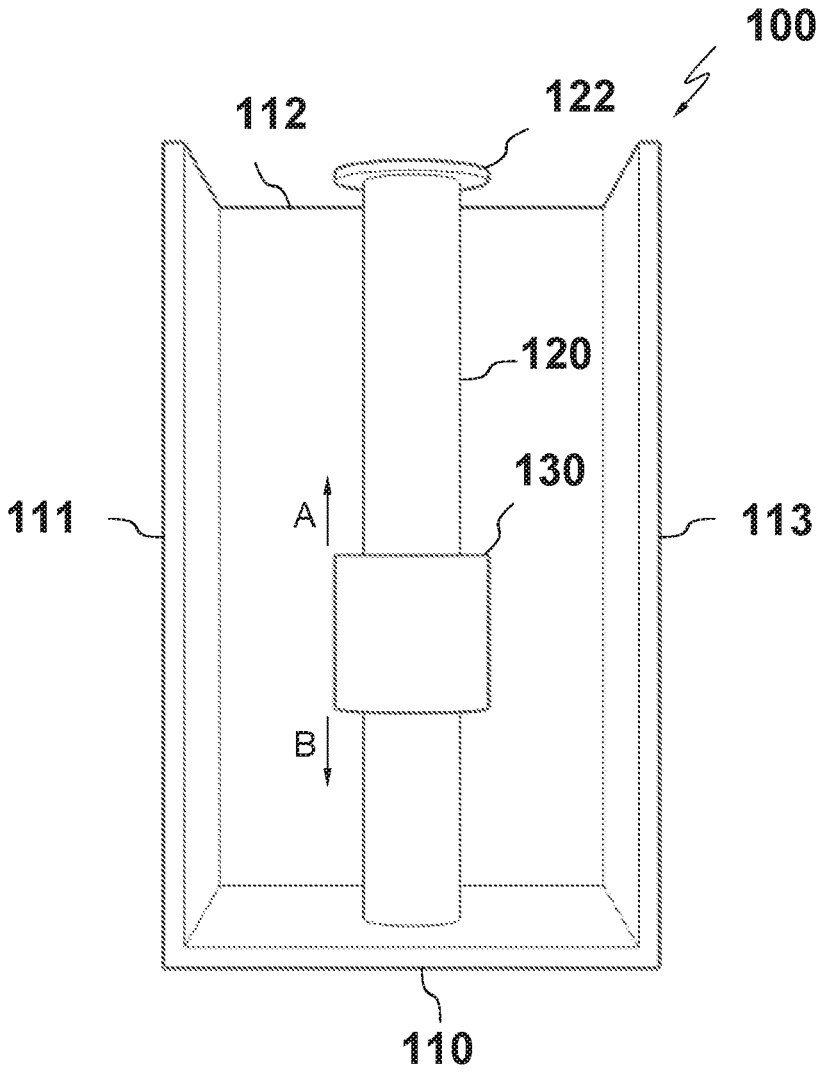
FIG. 2 depicts a top view the illustrated schematic of the transformer tie down of FIG. 1, according to one or more embodiments shown and described herein.

The shaft member 120 may also include a spacer 130. The spacer 130 may be any component capable of being positioned, for example, sliding along or clipping to the shaft member 120, between the flange 122 end of the shaft member 120 and the back wall 110. The spacer 130 operates to assist in aligning and positioning the securing strap around the shaft member 120. For example, the position of the spacer 130 along the shaft member 120 may be adjusted depending on the size of the securing strap used to secure the transformer. That is, the distance between the spacer 130 and the flange 122 may be equal to or greater than the width of the securing strap. The length of the shaft member 120 defined by the portion between the spacer and the flange 122 is referred to as a receiving portion for the securing strap. Turning to FIG. 2, a top view the illustrated schematic of the transformer tie down 100 shown in FIG. 1 is depicted. FIG. 2 further illustrates that the spacer 130 may slide along the shaft member 120 in either the direction of arrow A or arrow B. In some embodiments, the spacer 130 may be secured to the shaft member 120. For example, the spacer 130 may be secured to the shaft member 120 via a weld, glue, or the like. In some instances, the spacer 130 may include a set screw (not shown), a grub screw (not shown), or the like that may be selectively inserted and tightened to secure the spacer 130 at a position along the length of the shaft member 120.

Referring now to FIG. 3, an illustrative example of an overhead transformer 200 is depicted. While the transformer tie down 100 (FIGS. 1 and 2) may be used to secure a variety of different sizes and shapes of transformers, the transformer tie down 100 is depicted and described with respect to an overhead transformer 200 having a cylindrical shape. In general, an overhead transformer 200 has a cylindrical shape with one or more mounting brackets 210 and 220 attached to the housing of the overhead transformer 200. The one or more mounting brackets 210 and 220 are used to secure the overhead transformer 200 to a utility pole. For example, each of the mounting brackets 210 or 220 may be configured as depicted in FIG. 3. The mounting brackets 210 and 220 may include frame housings 212 and 222 that are attached to and extend from the housing 205 of the overhead transformer 200, respectively. The frame housings 212 and 222 may include slots 215 and 225 for receiving a mounting apparatus (not shown) to attach the overhead transformer to the utility pole (not shown). The mounting brackets 210 and 220 may also be used to secure the overhead transformer 200 during transportation. The present disclosure describes an apparatus that provides an efficient and simple method for securing the overhead transformer 200 with a securing strap or the like for transportation.

Figure 4:
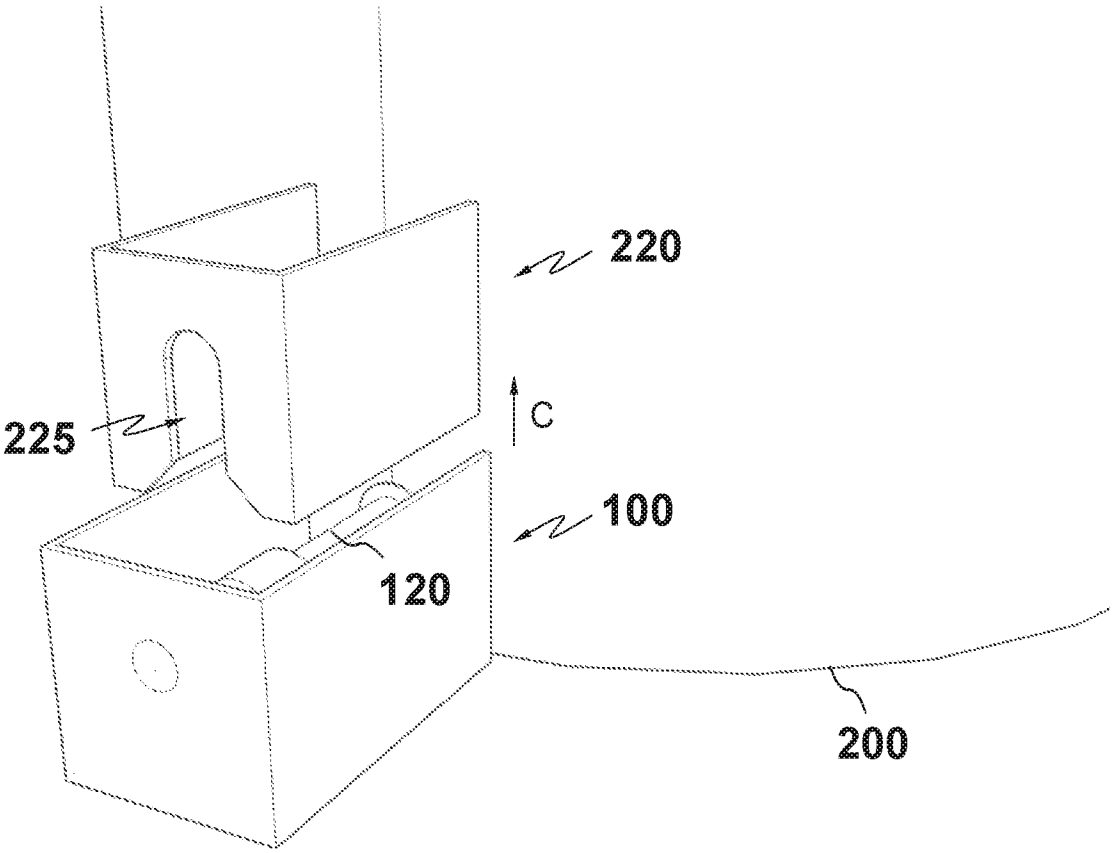
FIG. 4 depicts a schematic of an overhead transformer having a mounting bracket and a transformer tie down positioned for installation with the mounting bracket, according to one or more embodiments shown and described herein.
Figure 6:
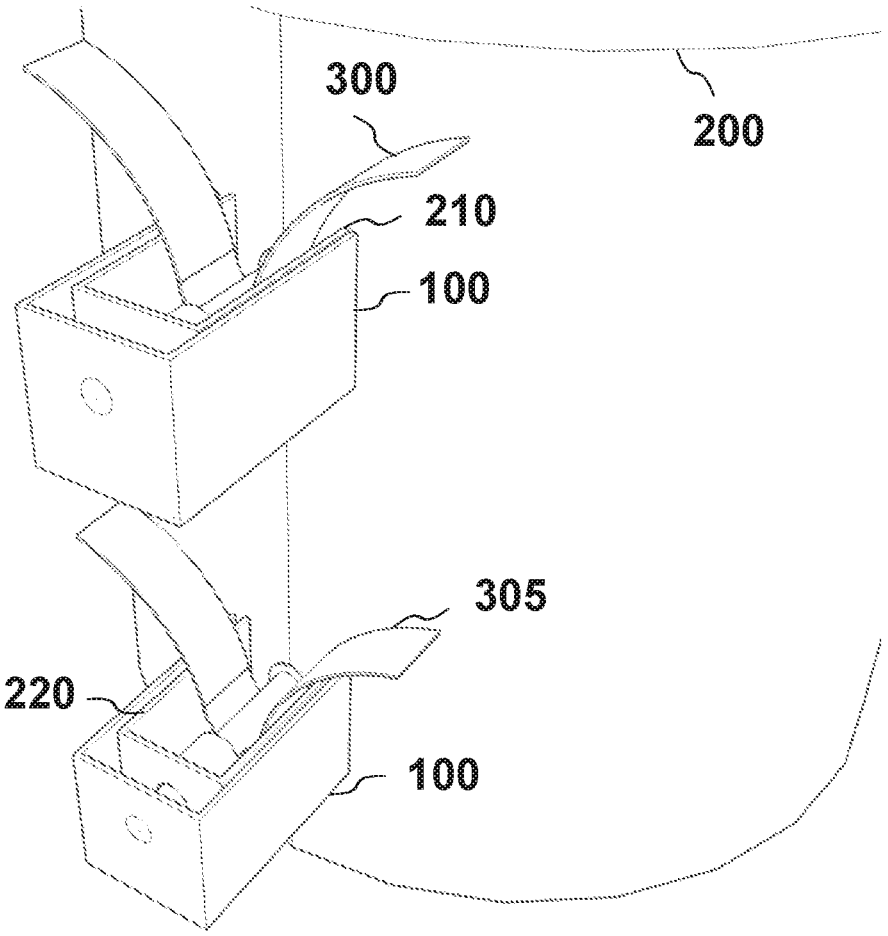
FIG. 6 depicts a perspective view illustrating the installation of a securing strap with the transformer tie down as installed with the mounting brackets of the overhead transformer, according to one or more embodiments shown and described herein.

FIGS. 4-6 will now depict the installation and operation of the transformer tie down 100 with reference to the overhead transformer 200. Referring to FIG. 4, a schematic of an overhead transformer 200 having a mounting bracket 220 and a transformer tie down 100 positioned for installation with the mounting bracket 220 is depicted. In some embodiments, the transformer tie down 100 is positioned below the mounting bracket 220 such that the transformer tie down 100 may be advanced in the direction of arrow C when installed with the mounting bracket 220. The shaft member 120 of the transformer tie down 100 may be received by the slot 225 of the mounting bracket 220.

Referring now to FIG. 5, a perspective view of two transformer tie downs 100 installed with the mounting brackets 210 and 220 of the overhead transformer 200 is depicted. In some embodiments, the transformer tie down 100 receives the mounting brackets 210 and 220 within its housing thereby forming at least a partial enclosure around the individual mounting brackets 210 and 220. Furthermore, the shaft member 120 is received within the slots 215 and 225 of the mounting brackets 210 and 220, respectively.

Turning now to FIG. 6, a perspective view illustrating the installation of a securing strap 300 and 305 with the transformer tie down 100 as installed with the mounting brackets 210 and 220 of the overhead transformer 200 is depicted. FIG. 6 depicts only a portion of the securing straps 300 and 305. In embodiments, the securing straps 300 and 305 may be coupled to anchor points (not shown) on a vehicle and tension may be controller by a ratchet mechanism that is coupled in line with the securing strap 300 and 305. The securing straps 300 and/or 305 may be looped around and/or between the shaft member 120 (FIG. 5) and the bottom wall 112 of the transformer tie down 100 (FIG. 1), such that the securing strap 300 and/or 305 extend out of a top portion of the mounting brackets 210 and 220 and a top portion of the transformer tie down 100. When tension is applied to the securing straps 300 and/or 305, the securing straps 300 and/or 305 pull and secure the transformer tie down 100 into a mating position with the mounting brackets 210 and 220. While embodiments depicted and described herein refer to two transformer tie downs 100 each coupled to one of the mounting brackets 210 and 220 of the overhead transformer 200, it should be understood that only one transformer tie down 100 may be used to secure the overhead transformer 200 to a transportation device and/or vehicle.

In some embodiments, the transformer tie down 100 may incorporate a securing strap 300. For example, one or more securing strap 300 may be fastened to the housing of the transformer tie down 100. In some embodiments, the securing strap is optionally retractable around the shaft member 120 or into the cavity of the housing. A retractable securing strap may be configured to extend from and recoil around the shaft member 120. In further embodiments, the transformer tie down 100 may include a fasten means such as magnets, clips, or bolting means such that it may be secured to a side wall of a transportation device or a vehicle. The transformer tie down 100 may operate as an anchor point for one or more other transformer tie downs 100.

It should be understood that the embodiments described herein are directed to devices and methods of securing an overhead transformer to a vehicle for transportation. The transformer tie down provides a means for attaching a securing strap to a mounting bracket of an overhead transformer. A securing strap may be connected to anchor points on the vehicle while a portion of the strap is forms an open-loop that is fed into and through the mounting bracket of the overhead transformer. The transformer tie down includes a shaft member that extends from a closed end of a U-shaped housing toward an open end of the U-shaped housing. The shaft member may be positioned such that the open-loop of the securing strap is between the shaft member and a bottom surface of the U-shaped housing. As the securing strap is tightened the transformer tie down engages the mounting bracket of the overhead transformer and secures the overhead transformer to the vehicle.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

I claim:

1. An apparatus for securing a transformer that includes at least one mounting bracket coupled to an exterior surface of the transformer, the at least one mounting bracket having a first length, a first height, and a first width to define a mounting bracket having an interior cavity, the apparatus comprising:

a housing comprising: a second length, a second height, and a second width to define a housing interior cavity with at least one interior surface, wherein the second length is larger than the first length of the mounting bracket and the second width is larger than the first width such that the mounting bracket is receivable into the housing interior cavity; and a shaft member including a third length, a third height, and a third width to define an exterior surface, the shaft member extending from the at least one interior surface along the second length within the housing interior cavity, wherein the third width is smaller than the first width and the second width to receive a securing strap around at least a portion of the exterior surface of the shaft member within the interior cavity of the mounting bracket to secure the transformer to the apparatus via the at least one mounting bracket.

2. The apparatus of claim 1, wherein the second length, the second height, and the second width of the housing forms an elongated U-shaped structure.

3. The apparatus of claim 2, wherein the elongated U-shaped structure is a rectangular elongated U-shaped structure.

4. The apparatus of claim 2, wherein the elongated U-shaped structure is a rounded elongated U-shaped structure.

5. The apparatus of claim 1, further comprising a spacer positioned around the shaft member, wherein the spacer is selectively positionable along the third length of the shaft member to define a receiving portion between the spacer and an end of the shaft member wherein the securing strap is secured around at least a portion of the receiving portion of the shaft member.

6. The apparatus of claim 5, wherein the spacer is selectively secured at a position along the third length of the shaft member.

7. The apparatus of claim 1, further comprising a flange coupled to an end of the shaft member, wherein the flange includes a diameter that is greater than a diameter of the shaft member.

8. The apparatus of claim 7, further comprising a retractable securing strap configured to extend from and recoil around the shaft member.

9. The apparatus of claim 1, wherein the mounting bracket includes a slot configured along the first width and extending a defined distance along the first height of the mounting bracket, and the shaft member includes a diameter to fit within the slot of the mounting bracket of the transformer.

10. An apparatus for securing a transformer that includes at least one mounting bracket coupled to an exterior surface of the transformer, the at least one mounting bracket having a first length, a first height, and a first width to define a mounting bracket having an interior cavity, the apparatus comprising:

a housing configured in an elongated U-shaped structure having a housing interior cavity defined by a second length, a second height, and a second width and at least partially enclosed on one end of the elongated U-shaped structure, wherein the second length is larger than the first length of the mounting bracket and the second width is larger than the first width such that the mounting bracket is receivable into the housing interior cavity; and a shaft member extending from the enclosed end of the elongated U-shaped structure within the elongated U-shaped structure along a portion of a length of the housing.

11. The apparatus of claim 10, wherein the elongated U-shaped structure is a rectangular elongated U-shaped structure.

12. The apparatus of claim 10, wherein the elongated U-shaped structure is a rounded elongated U-shaped structure.

13. The apparatus of claim 10, further comprising a spacer positioned around the shaft member, wherein the spacer is selectively positionable along the length of the shaft member to define a receiving portion between the spacer and an end of the shaft member wherein a securing strap is secured around at least a portion of the receiving portion of the shaft member.

14. The apparatus of claim 13, wherein the spacer is selectively secured at a position along the length of the shaft member.

15. The apparatus of claim 10, further comprising a flange coupled to an end of the shaft member, wherein the flange includes a diameter that is greater than a diameter of the shaft member.

16. The apparatus of claim 10, wherein the shaft member extending from the enclosed end of the elongated U-shaped structure is positioned about equidistant along the second width of the elongated U-shaped structure.

17. The apparatus of claim 10, wherein the mounting bracket includes a slot configured along the first width and extending a defined distance along the first height of the mounting bracket, and the shaft member includes a diameter to fit within the slot of the mounting bracket of the transformer.

18. A method for securing a transformer that includes a mounting bracket coupled to an exterior surface of the transformer, the mounting bracket having a first length, a first height, and a first width to define the mounting bracket having an interior cavity, the method comprising:

positioning an apparatus such that the mounting bracket is received within a housing of the apparatus, wherein the housing comprising:

a second length, a second height, and a second width defining a housing interior cavity with at least one interior surface, wherein the second length is larger than the first length of the mounting bracket and the second width is larger than the first width such that the mounting bracket is receivable into the housing interior cavity, and a shaft member extending from the at least one interior surface along a portion of the second length within the housing interior cavity;

feeding a securing strap around at least a portion of the shaft member such that opposing ends of the securing strap extend out of the housing interior cavity; and applying tension to the opposing ends of the securing strap such that the housing is pulled into a mating position with the mounting bracket of the transformer.

19. The method of claim 18, further comprising adjusting a position of a spacer slidably coupled to the shaft member.

20. The method of claim 18, further comprising securing each end of the securing strap to an anchor point.

* * * * *